US005309167A

United States Patent [19]

Cluniat et al.

[11] Patent Number: 5,309,167

[45] Date of Patent: May 3, 1994

[54] MULTIFOCAL RECEIVING ANTENNA WITH A SINGLE AIMING DIRECTION FOR SEVERAL SATELLITES

[75] Inventors: Claude Cluniat, Verneuil S/Seine; Jean-Jacques Delmas, Meudon, both of France

[73] Assignees: Thomson-LGT Laboratoire General des Telecommunications, Conflans Sainte Honorine; Telediffusion de France S.A., Montrouge, both of France

[21] Appl. No.: 998,648

[22] PCT Filed: Oct. 31, 1990

[86] PCT No.: PCT/FR90/00785

§ 371 Date: May 16, 1991

§ 102(e) Date: May 16, 1991

[87] PCT Pub. No.: WO91/06988

PCT Pub. Date: May 16, 1991

Related U.S. Application Data

[63] Continuation of Ser. No. 689,040, May 16, 1991, abandoned.

[30] Foreign Application Priority Data

Oct. 31, 1989 [FR] France ..... 89 14287

[51] Int. Cl.[5] ..... H01Q 25/000; H01Q 21/240; H01Q 15/160; H01Q 17/000

[52] U.S. Cl. ..... 343/840; 343/895; 343/914

[58] Field of Search ..... 343/840, 895, 912–914, 343/781 P, 835, 836; H01Q 1/36, 11/02–11/08, 19/10–19/18, 21/24, 17/00, 25/00, 15/14–15/16

[56] References Cited

U.S. PATENT DOCUMENTS

| | | | |
|---|---|---|---|
| 2,663,016 | 12/1953 | de Pillot de Collieny | 343/914 |
| 3,184,747 | 5/1965 | Käch | 343/895 |
| 4,513,293 | 4/1985 | Stephens | 343/914 |
| 4,544,928 | 10/1985 | Afifi et al. | 343/914 |

FOREIGN PATENT DOCUMENTS

| | | | |
|---|---|---|---|
| 0186496 | 7/1986 | European Pat. Off. | H01Q 19/17 |
| 0270294 | 6/1988 | European Pat. Off. | H01Q 15/14 |
| 1114862 | 10/1961 | Fed. Rep. of Germany | H01Q 17/00 |
| 0091554 | 8/1978 | Japan | 343/781 CA |
| 0003210 | 1/1985 | Japan | 343/781 P |
| 0173804 | 7/1987 | Japan | 343/914 |
| 0131604 | 6/1988 | Japan | H01Q 21/24 |
| 0037107 | 2/1989 | Japan | H01Q 19/17 |
| 0254009 | 10/1989 | Japan | 343/914 |
| 2178904 | 2/1987 | United Kingdom | H01Q 19/13 |
| 2188166 | 9/1987 | United Kingdom | H01Q 15/16 |

OTHER PUBLICATIONS

Patent Abstracts of Japan vol. 6, No. 151 (E-124)(1029) Aug. 11, 1982, & JP-A-57 73506 (Nippon Denshin Denwa Kosha) May 8, 1982.

*Primary Examiner*—William Mintel
*Assistant Examiner*—Peter Toby Brown
*Attorney, Agent, or Firm*—Oblon, Spivak, McClelland, Maier & Neustadt

[57] ABSTRACT

The receiving antenna comprises at least two sectors or sections of paraboloids focusing the radiation onto their axes at points $F_1$ and $F_2$ respectively offset by a whole number of wavelengths of the received radiation. Each sector or section is associated with a helicoidal source located in its focal zone and having the same axis as that of the corresponding sector.

19 Claims, 6 Drawing Sheets

SQUARE MULTI-FOCAL FLAT ANTENNA

MULTIFOCAL RECEIVING ANTENNA WITH A SINGLE AIMING DIRECTION FOR SEVERAL SATELLITES

This application is a continuation of application Ser. No. 07/689,040, filed on May 16, 1991, now abandoned.

TECHNICAL FIELD

The invention relates to satellite receiving equipment available in the form of individual receiving stations and more particularly to receiving antennas which can be used with a microwave frequency head and a demodulator in order to constitute such stations.

BACKGROUND

The antenna of a satellite receiving station is conventionally constituted by a parabolic reflector. This reflector is most often of circular or ovoid shape. In all cases, the reception principle remains the same: the electromagnetic waves are focused onto the reception focus. The signal is received by a "source" and then amplified by the microwave frequency head.

There are several types of parabolic antennas. The three main types of antennas are as follows:

The antenna of the type having symmetry of revolution, or the "Prime focus" type whose microwave frequency head is supported by a tripod fixed to the outer edges of the parabola, and directly placed in the proximity of the focus of the reflector: the presence of the head in the active part of the parabola results in a masking effect and in diffraction phenomena. A waveguide (feeder) is sometimes used to convey the signal from the source to the microwave frequency head (placed at the rear in this case).

The "Cassegrain" type antenna whose microwave frequency head is installed at the rear of the main reflector and receives the waves reflected on a hyperbolic sub-reflector which reconcentrates the signals received by the main reflector towards the low noise amplifier (called LNA "Low Noise Amplifier"); this sub-reflector is the generator of a masking effect.

The antenna of the offset illumination type which is a parabolic antenna having an off centered focus: the low noise amplifier and the source are offset in such a way as to reduce the masking effect.

The choice of the type of antenna principally depends on the size of the microwave frequency head used: a voluminous microwave frequency head, if it is placed at the center of the parabola, reduces its gain. Furthermore, the materials used for constructing parabolic reflectors are principally of the plastic or metallic (aluminium) type. Finally, the diameter of the parabola is a function of the merit factor, G/T, linking the gain G of the parabola and the overall noise temperature (T) desired on the station. This diameter has been able to decrease considerably in recent years, with a constant G/T, because of technological improvements in the amplifiers which result in a reduction of their noise temperature. The diameter of the parabola defines its beam width and, in addition to their discretion, the major advantage of parabolas of small diameter is the ease of aiming because of the corresponding increase in beam width. However, at the same time, the beam width determines the sensitivity of the system to interference coming from satellites adjacent to the satellite aimed at, which limits the possible reduction in diameter.

Furthermore, most manufacturers are currently developing array antennas, called flat antennas, intended either for receiving television transmissions, or for communications, mobile or fixed, for data transmission for professional use: the entire area of the antenna receives the radio signals transmitted by the satellite; an array of receiving microelements is placed in parallel and the gain is a function of the area of the antenna.

The efficiency of such flat antennas reduces considerably when the antenna area increases because of the loss generated in the summing systems.

But, the use of a flat antenna is capable of simplifying the procedures and therefore of limiting the costs of installations: a flat antenna can be installed almost vertically on a wall, or stuck to a roof. It merges with the decor (greater aesthetic qualities given it by its design): small thickness, reduced dimensions (it is configured in the form of squares of side 35 to 70 cm), lightness, discretion;

In order to be capable of receiving programmes from several satellites a flat antenna should be motorised. Array antennas with electronic aiming are being developed. They will allow the reception of transmissions from several adjacent satellites without movement. But no production for the general public is known at present as each microelement must be controlled in phase which considerably affects the gain and the noise temperature of the antenna.

Furthermore, in the current state of the art, these flat antennas have three big disadvantages:

the receiving gain of a flat antenna is on average 25% lower than that of a parabolic antenna, the bandwidth is limited and in order to receive the 2 circular polarisations, 2 antennas are necessary;

the production cost of such an antenna is high, principally for two reasons:

1. expensive materials are necessary in order to minimise losses;
2. the matrix represented by the receiving area of the antenna requires an individual connection of each of the microelements.

With regard to the microwave frequency heads, these are composed of two elements: a low noise amplifier (LNA) and a low noise converter (LNC for Low Noise Converter), which can be connected as independent modulators one after the other, or integrated in a single block (LNB: Low Noise Block down converter).

Furthermore, the frequency bands allocated to television transmissions by geostationary satellite have been optimized to release a sufficient number of channels for all potential users (countries and international organizations). Consequently, satellites of the DBS type use two types of electromagnetic radiation polarized in opposite directions. Two transmissions can thus coexist on a same channel: their opposite polarizations enable them to be separated on reception.

The polarisations used by the two types of television satellites are as follows.

For direct television broadcast satellites:

right circular polarization (or "right hand circular polarisation") for example TDF1, BSB, BS, OLYMPUS;

left circular polarization (or "left hand circular polarization") for example TVSAT, OLYMPUS.

For telecommunications satellites:

horizontal linear polarisation: for example Intelsat V, ECS 1 F1 vertical linear polarization: for example Intelsat V, ECS 1 F1, Telecom 1; the channels of the satellites of the "Eutelsat" and "Intelsat" organizations allocated to television transmissions are divided into two sub-groups of programmes, each of which corresponds to a different polarization.

When a receiving station is intended to receive several types of polarizations, depolarizers are provided in order to allow the user to choose the desired polarization at will. The choice of these systems depends on the nature of the polarizations received.

In the case of horizontal and vertical polarisations, it is necessary to have recourse to a motorized polarization changing system, most often mounted on the waveguide of the parabola.

In the case of right and left circular polarizations (direct television broadcast satellites), the simultaneous reception of polarized signals requires a double output waveguide, equipped with an orthomode transducer allowing the mounting on a same parabola of two microwave frequency heads each dedicated to a different polarization.

Motorized systems intended to ensure the switching of the microwave frequency heads at the center of the parabola are now developed, but the reliability of these equipments is insufficient.

Very wide band heads, which are multi-frequency by band switching or agile frequency synthesis, should allow the reception of all of the frequencies allocated to television transmissions. But such multi-band heads will not quickly be available at reasonable prices.

The output of the microwave frequency head is connected to a demodulator which converts and demodulates the signal received in the satellite intermediate band (BIS) 950 to 1750 MHz. The demodulator allows the selection of the satellite channels to be carried out. Only demodulators having a very wide input band, which cover the entire frequency range from 950 to 1750 MHz, are capable of receiving the transmissions from all of the satellites which will cover Europe in the coming years. At present, these demodulators are only used to the maximum of their capabilities in motorized stations intended for the reception of several satellites.

SUMMARY OF THE INVENTION

The problem solved by the present invention is the reception by means of a single, fixed antenna of transmissions received from one or other of several satellites located in the same orbital position but polarized in different ways.

The subject of the invention is therefore a receiving antenna with a single aiming direction, allowing the simultaneous reception of several satellites located in the same orbital position, allowing the selection of one of the left or right circular polarizations with correct decoupling (FIG. 1), or optionally a combination of these two polarizations in order to restitute a linearly polarized radiation, which does not require any motorization and which is furthermore of rather reduced size and of low cost.

For this purpose the reflector of the antenna is of the parabolic type with symmetry of revolution or with offset illumination, but with essential adaptations which allow it to be rendered multi-focal and is associated with several correctly decoupled sources for the reception of radiations having different polarizations.

According to the invention a multi-focal receiving antenna with a single aiming direction, for several satellites, is characterized in that it comprises a reflector constituted from several sectors of paraboloids each associated with a source located on its axis, these sectors having axes in the some direction and foci offset by a whole number of wavelengths of the radiation to be received, and in that it comprises, for the coupling of the radiation, sources located in the zones of concentration of the radiation, having axes merged with the axes of the sectors of paraboloids associated with them and adapted to the reception of differently polarized radiations.

BRIEF DESCRIPTION OF THE DRAWINGS

The invention will be better understood and other characteristics will appear with the help of the following description referring to the appended drawings in which.

DETAILED DESCRIPTION OF THE PREFERRED EMBODIMENTS

In order to obtain a multi-focal antenna, the invention provides a reflector formed from several sectors or sections of paraboloids, each of these sectors focusing the parallel radiation which it receives into a focal zone where a source is disposed.

In order to be able to receive both of the two circular polarizations, right and left, two sectors or sections are provided and each of the two sectors or sections of paraboloids of the reflector is associated with a helicoidal surface wave source, the two sources being spirals or helicoids having opposite directions and having axes merged with the axes of the sectors or sections of paraboloids with which they are associated.

Figure 1:
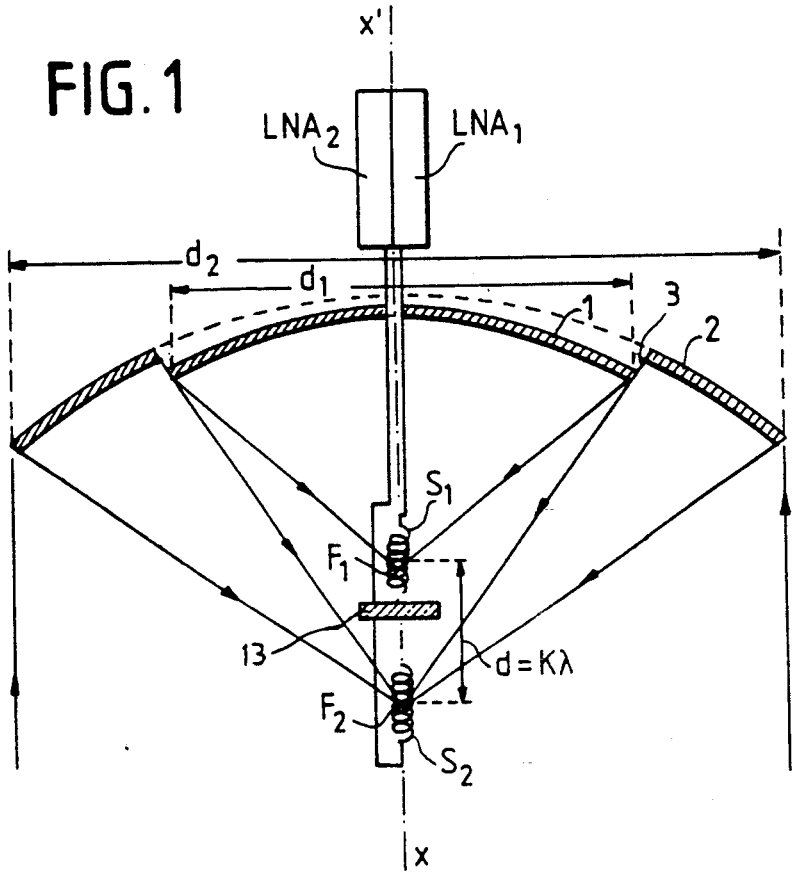
FIG. 1 is the basic diagram of a first embodiment of a multi-focal antenna according to the invention.

FIG. 1 shows a first embodiment of a quasi-flat antenna according to the invention in which the two sectors or sections of paraboloids have the same axis x'x, the first 1, being the central sector of a paraboloid of focal axis F1 and having an outer diameter d1, the other being a ring of a paraboloid having the same focal axis F2, having an inner diameter d1 and an outer diameter d2. These two sectors or sections of paraboloids are disposed such that the distance d between their respective foci is equal to K $\lambda$ where K is an integer and $\lambda$ is the wavelength of the received radiation. The virtual apices of the paraboloids are also in a relationship of the k' $\lambda$ type. Furthermore, in order to reduce the size of the resultant structure, the inner paraboloid sector is brought inside the ring-shaped paraboloid sector, the corresponding surfaces not being continuous but, on the contrary discontinuous and connected by a section of cone 3. Thus the depth of the structure is much smaller than if the paraboloids were simply adjoining; the storage volumes are consequently much lower and the transport costs are minimized.

In the focal zones of these two sectors or sections of paraboloids there are disposed two sources, $S_1$ and $S_2$ respectively, which are helicoidal and whose pitch, number of turns and direction of winding are adapted to the reception of right circularly polarized radiation and left circularly polarized radiation respectively. These two sources are connected to low noise amplifiers $LNA_1$ and $LNA_2$ respectively which are part of the microwave frequency heads (not fully shown) located to the rear of the paraboloids and connected by coaxial cables, the core of the cable being extended by the spiral while the outer conductor is terminated by a disc. A more accurate representation of the sources is given in FIGS. 4 to 9 which will be described in greater detail hereafter. In the diagram of FIG. 1, the source $S_1$ is connected in order to be excited in a "back-fire" mode, while the source $S_2$ is connected in order to be excited according to a so-called "end-fire" mode. The radiation focused by the paraboloid sector 1 excites the source $S_1$ which feeds the low noise amplifier $LNA_1$; similarly the sector or section of paraboloid 2 focuses the radiation which it receives towards the source $S_2$ which converts the radiation and transmits it to the low noise amplifier $LNA_2$.

It is important that the radiations received by $S_1$ and $S_2$ respectively are correctly decoupled, that is to say that each of the sources selectively receives one of the two circularly polarized radiations. Now, the radiation received by the reflector 1 and focused onto $S_1$ produces a backward radiation which disturbs the source $S_2$ and contributes to the deterioration of the signal which it receives, unless special arrangements are made for avoiding these interferences or for using the backward radiation to contribute to the useful signal on $S_2$. In FIG. 1 there has been shown an electromagnetic absorber 13, which allows the backward radiation not picked up by $S_1$ to be prevented from disturbing the source $S_2$.

Figure 2:
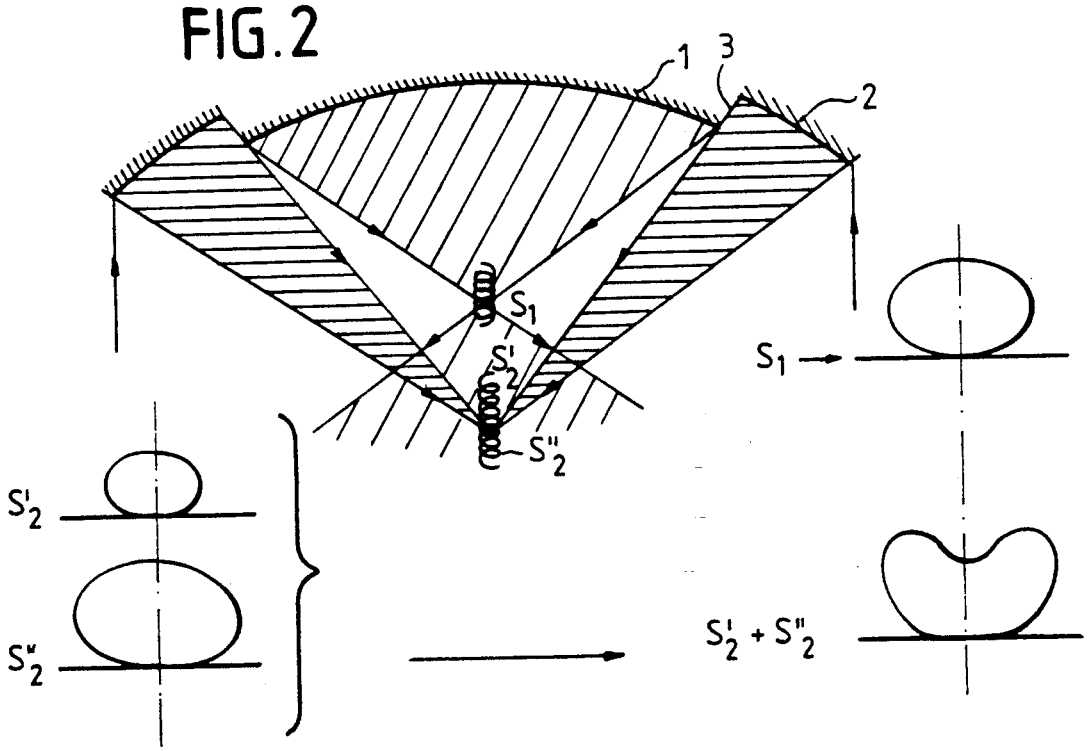
FIG. 2 is the diagram of an antenna of the same type, accompanied by explanatory diagrams.

FIG. 2 shows an antenna comprising reflectors similar to those of FIG. 1 in which instead of providing an absorber between the two sources, a special structure of sources is provided which allows, instead of eliminating the backward radiation created by the first rerflector, after its focus, the use of this backward radiation in such a way as to increase the gain, which possibly allows a reduction in the area of the reflector 2. As before, the paraboloid 1 is associated with the source $S_1$, its radiation pattern, shown in the figure, corresponding to the received radiation cone. But the source $S_2$ is constituted from two spirals or helicoids $S'_2$ and $S''_2$ whose phases are adjusted in such a way that the combination of the two radiation patterns creates a resultant pattern in which a hole is provided along the axis x'x, the backward radiation transmitted after the focus $F_1$ contributing to the overall establishment of a radiation pattern similar to that obtained for the source $S_1$. This second solution has the advantage of making the best use of all of the radiation received by the reflectors, and therefore optimizes the resultant gain over the two sectors or sections of the antenna with respect to the useful areas of the reflectors.

Figure 3:
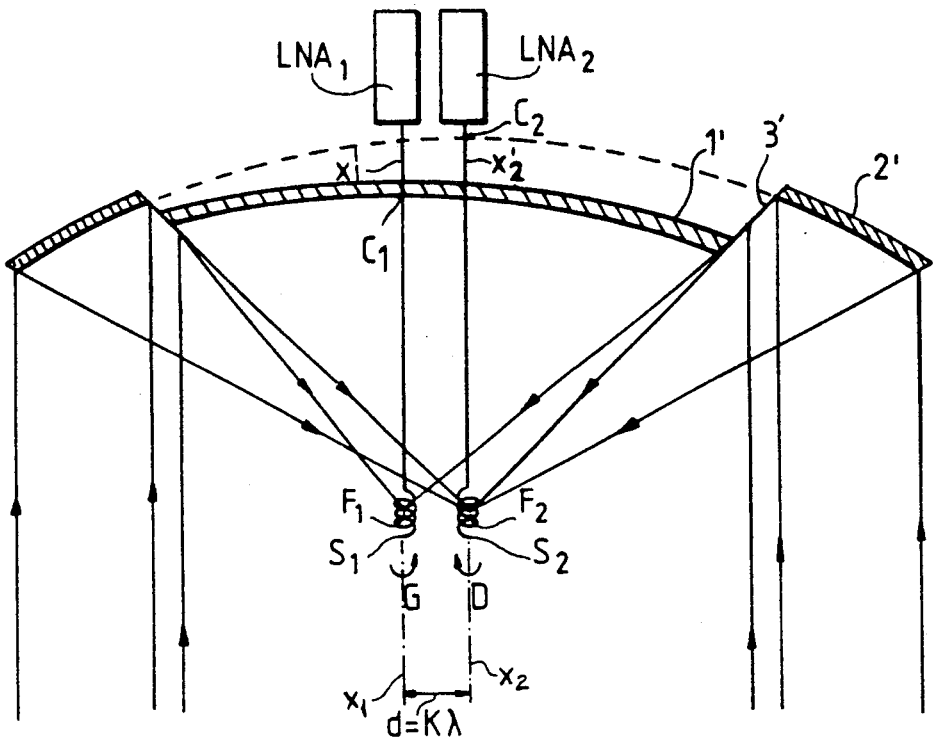
FIG. 3 is the diagram of a second embodiment of a multi-focal antenna according to the invention.

FIG. 3 shows a second embodiment of the multi-focal antenna according to the invention. In this embodiment the two sectors or sections of paraboloids have parallel axes, $x_1x'_1$ and $x_2x'_2$ which are no longer merged as in the embodiments shown in FIGS. 1 and 2, such that a line extending from one focal point to the other is perpendicular to each of the parallel axes. As in the preceding figures the distance $F_1F_2$ between the two foci of the sectors or sections of paraboloids d is equal to $K\lambda$. In this embodiment the two helicoidal sources $S_1$ and $S_2$ are excited according to the so-called "back-fire" modes, the two helicoids being wound in opposite directions as before in order to be excited by the left, G, and right, D, polarised radiations respectively. The corresponding reflectors 1' and 2' are no longer symmetrical with respect to their axes $x_1x'_1$ and $x_2x'_2$, with the axes determined mathematically by the respective apices $C_1$, $C_2$ and foci $F_1$, $F_2$ of the paraboloids of which 1' and 2' are sectors. In other words, the sectors may be asymmetrical sectors from their respective paraboloids (which can yield a somewhat tilted appearance as shown in FIG. 3), however, the axes of the paraboloids (i.e. from focal point $F_1$, $F_2$ to apex $C_1$, $C_2$) are parallel.

Figure 4:
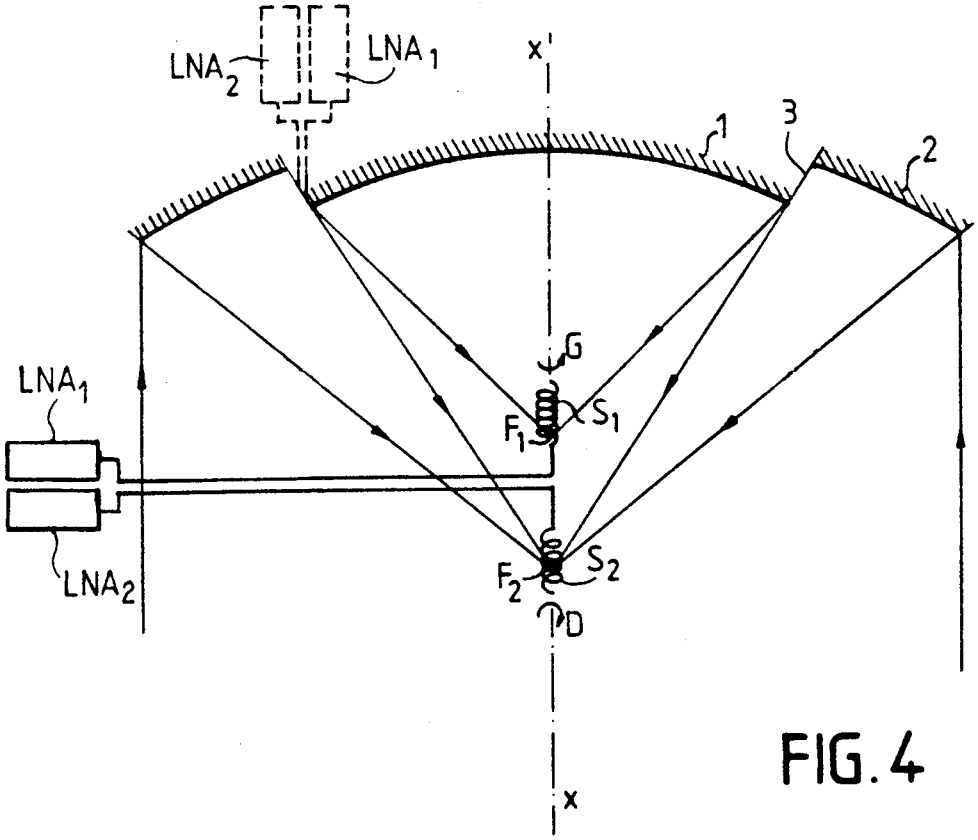
FIG. 4 is the diagram of a third embodiment of a multi-focal antenna according to the invention.

FIG. 4 shows a third embodiment of the multi-focal quasi-flat antenna according to the invention in which the reflectors have a symmetrical structure, of the type of that shown in FIGS. 1 and 2, the two helicoidal sources being aligned on the common axis x'x of the reflectors, these respectively "end-fire" and "back-fire" sources $S_1$ and $S_2$ being connected by the very low loss coaxial cables to the corresponding low noise amplifiers $LNA_1$ and $LNA_2$ through a mechanical structure, the connection points of the helicoids to the coaxial cables being located in the middle of the segment $F_1$ $F_2$ connecting the two foci of the two sectors or sections of paraboloids. As shown in FIG. 4, Low Noise Amplifiers ($LNA_1$ and $LNA_2$) can be either mounted at a side of the antenna (as shown in solid line) or in the back of the antenna (as shown for example by the broken lines). This structure is a little simpler mechanically than that shown in FIG. 1 where the coaxial cables connecting the sources $S_1$ and $S_2$ are not similar, the second one being substantially longer than the first one. On the contrary, the structure shown in FIG. 4 is symmetrical in the sense that both of the coaxial cables are of the same length, the central access being connected to the low noise amplifiers by a structure of coaxial cables offset with respect to the axis x'x of the reflectors. Another advantage of central application structures is that an electronic circuit can be housed in the vicinity of the connection points, particularly in the case in which it is desired to combine the two polarizations in order to restitute the radiation received with a linear polarization.

FIGS. 5 to 9 show in detail the possible structures of the two helicoidal sources aligned on the common axis of the reflectors.

Figure 5:
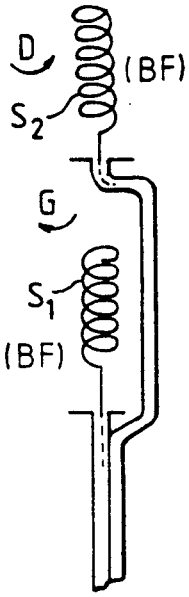
FIGS. 5 to 9 are more detailed diagrams of various types of double sources, having the same axis, which can be used with a reflector in two sections of the type of the one shown in FIG. 1.

FIG. 5 shows a structure in which the two helicoidal sources are excited according to a "back-fire" mode, the first $S_1$ being disposed as in FIG. 1, while the second is also fed in "back-fire" mode which was not the case of source $S_2$ in FIG. 1. In all of these figures the two helicoids $S_1$ and $S_2$ are wound in such a way that they are respectively adapted to one of the two circular polarizations, right D or left G respectively.

Figure 6:
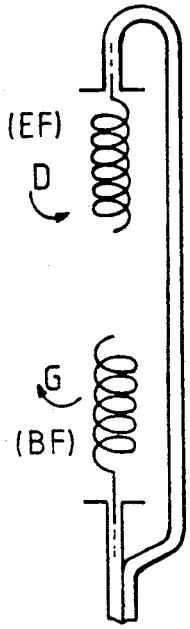

FIG. 6 shows in greater detail the same embodiment of the sources as in FIG. 1, $S_1$ being excited in "back-fire" mode while $S_2$ is excited according to an "end-fire" mode.

Figure 7:
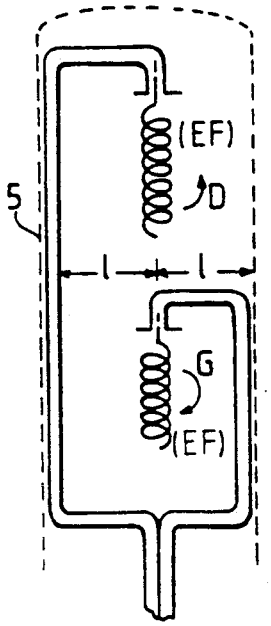

FIG. 7 shows another embodiment according to which the two helicoidal sources are excited according to an "end-fire" mode, the coaxial cables connecting these sources to the corresponding low noise amplifiers going around the sources at a distance l from the axis which is sufficient to not create interference.

Figure 8:
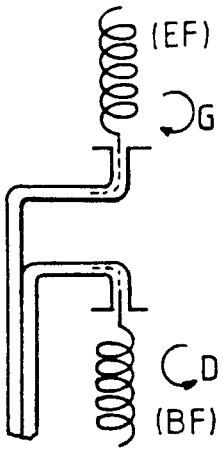

FIG. 8 shows in detail an embodiment of the sources such as those used in the multi-focal antenna shown in FIG. 4, with central connection of the sources which are excited in "back-fire" and "end-fire" modes respectively, the common feeder being offset with respect to the common axis of the helicoids.

Figure 9:
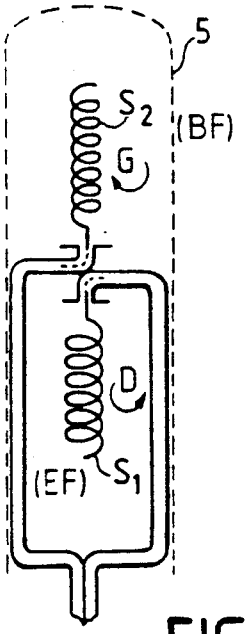

FIG. 9 shows another embodiment, also with central application, but in this embodiment the two coaxial cables are located symmetrically on either side of the source $S_1$ and join each other on the common axis of the helicoids. In this embodiment, as in the one shown in FIG. 7, the cables or portions of cables, situated symmetrically on either side of the common axis x'x of the helicoids can allow the supporting of a protective radome 5 shown in dotted line in these two figures.

Such an antenna therefore allows the reception of circularly polarized transmissions on one or other of the two channels, depending on the direction of the circular polarisation. It also allows the obtaining, by vector addition of the two channels, of the horizontal H or vertical V linear polarizations.

It has been mentioned above that the size was minimized by bringing the reflector of the central section inside the paraboloid in which the outer sector is formed by the intermediary of the section of cone 3.

Figure 10:
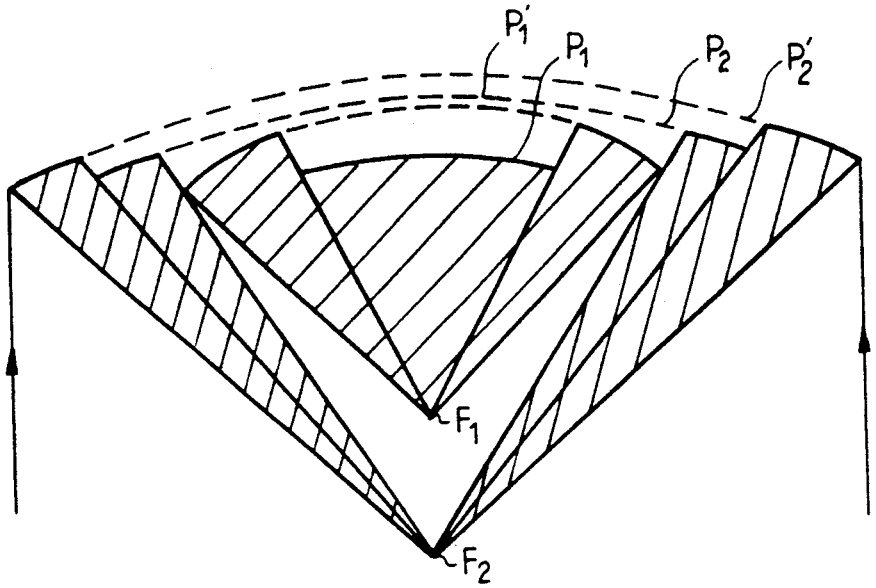
FIGS. 10 and 11 are variants of the antennas shown in FIGS. 1 and 3 respectively, having reduced size.
Figure 11:
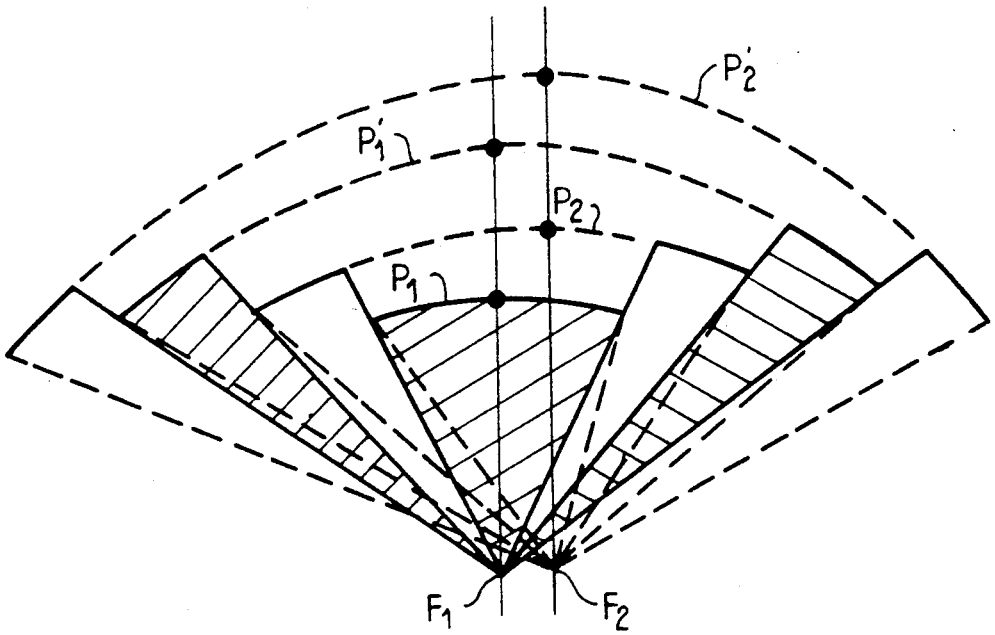

It is possible to minimize the size even more by approximating a flat structure, by replacing each of the reflectors in the shape of paraboloid with respective foci $F_1$ and $F_2$ by a set of sectors of paraboloid whose apices are offset by a whole number of half wavelengths, connected by sections of cone, all of the inner rings being brought inside the ring of largest diameter, as shown in FIGS. 10 and 11 in which the structures of FIGS. 1 and 3 have been shown with this refinement.

In FIG. 10, the two focusing zones, $F_1$ and $F_2$ spaced by K λ are aligned on the common axis of the sectors of paraboloids. The sectors of paraboloid $P_1$ and $P'_1$ which focus at $F_1$ are equivalent to the sector 1 of FIG. 1 and the sectors $P_2$ and $P'_2$ which focus at $F_2$ are equivalent to the sector 2 of FIG. 1.

In FIG. 11, the two focusing zones, spaced by K λ are located on two parallel axes, the first axis being a common axis for the sectors of paraboloids $P_1$ and $P'_1$ whose characteristics are such that they focus the radiation into the zone $F_1$, while the second axis is a common axis for the sectors paraboloid $P_2$ and $P'_2$ which focus the radiation into the zone $F_2$.

In these FIGS. 10 and 11, as in FIGS. 1 and 3, the various sectors are mechanically integral via connecting surfaces in the form of sections of cone. Any other distribution of sectors of paraboloid is of course possible provided that the radiation is focused as previously described.

It is clear that the resultant structures are of much smaller size than structures in which the paraboloids would be continuous and approximate to flat structures.

Figure 12:
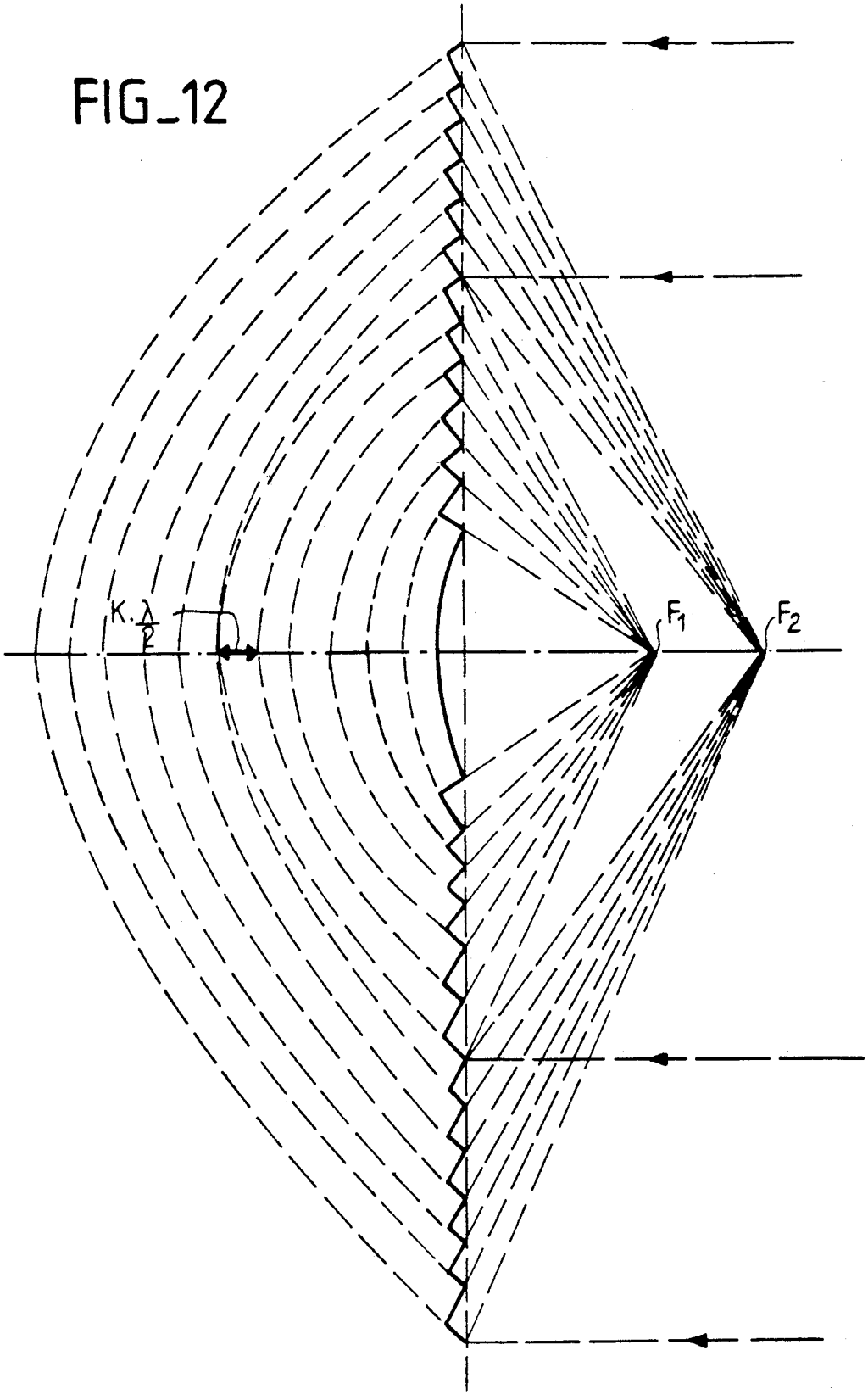
FIGS. 12 and 13 show a multi-sector quasi-flat antenna forming a square in projection.
Figure 13:
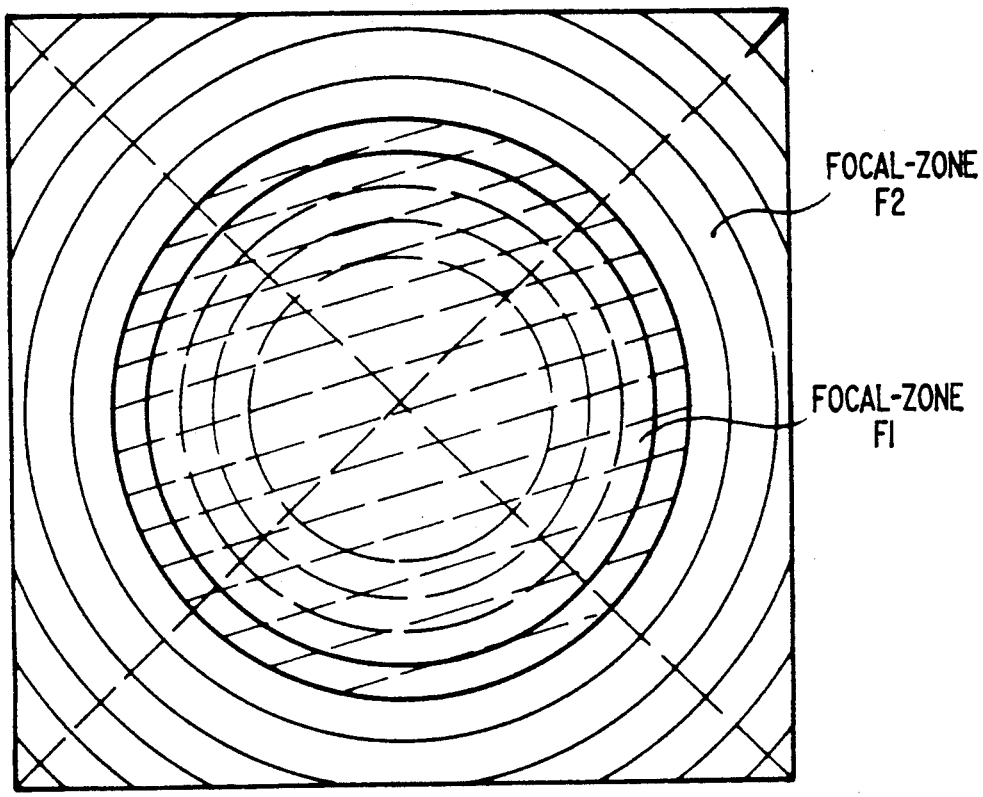

FIGS. 12 and 13 show an embodiment of a multi-sector quasi-flat antenna having two coaxial foci, in cross-section and in plan view respectively.

In order to confer a quasi-flat structure on this antenna, the sectors of paraboloid respectively focusing at the foci $F_1$ and $F_2$ are obtained from families of paraboloids whose apices are offset by k λ/2. For k=1, and F=12.5 GHz, the pitch on the axis is 12 mm.

The reflector of this antenna can have a circular cross-sectional projection along its axis but, in order to optimize the gain and the active area for a given storage volume, a rectangular or square projection area is preferred and has been shown in FIG. 13.

The invention is not limited to the embodiments precisely described and shown either with regard to the sectors or sections of paraboloids or to the sources and their arrangement; in particular, it is possible to consider a reflector forming more than two focusing zones, a surface wave source being disposed in each zone along the axis of the corresponding reflector. These sources can be helicoids as described above but can also be printed array sources or dielectric sources.

We claim:

1. A multi-focal receiving antenna for receiving radiation of a predetermined wavelength, said antenna having a single aiming direction for more than one satellite, the antenna comprising:

a reflector having at least two sectors of paraboloids, wherein respective axes of the paraboloids of the at least two sectors extend in a same direction with said at least two sectors having different focal points, and with the foci of said at least two sectors offset by a spacing equal to a whole number of wavelengths of the radiation of a predetermined wavelength to be received, said reflector having a quasi-flat structure with respect to a direction along said axes, said antenna further including a respective source for each of the at least two sectors for coupling the radiation, said sources located in zones of concentration of the radiation to be received, said sources merged with the respective axes of the at least two sectors of paraboloids, said sources respectively adapted for reception of differently polarized radiation; and wherein a first of said sectors is a sector of a paraboloid in which the paraboloid of the first of said sectors forms a central zone, and a second of said sectors is a sector of a paraboloid in which the paraboloid of the second of said sectors forms an external zone, and wherein said central zone is within said external zone.

2. The antenna of claim 1, wherein the sources are surface wave sources formed from helicoidal illuminators respectively connected to low noise amplifiers by coaxial cables.

3. The antenna according to claim 2, wherein two helicoidal illuminators are provided which are respectively adapted for the reception of right and left circular polarization components of the radiation.

4. The antenna of claim 3, wherein the sectors of paraboloids have the same axis, which is also the axis of helicoids of the helicoidal illuminators, the foci of the sectors of the paraboloids being spaced on said same axis by K λ, and each sector having a symmetry of revolution about said same axis, wherein K is an integer and λ is the wavelength of radiation to be received.

5. The antenna of claim 4, wherein the sector of a paraboloid having the shortest focal length is provided in a central section in order to form said first sector, said second sector of a paraboloid having the shape of a ring and having an inner diameter equal to an outer diameter of the first sector having the shortest focal length.

6. The antenna of claim 2, wherein the at least two sectors of paraboloids have parallel axes spaced by K λ, the foci of said sectors and the helicoids of said helicoidal illuminators respectively located on said parallel axes, and wherein an axis extending from a focal point on one axis to a focal of another axis is orthogonal to both of the parallel axes.

7. The antenna of claim 4, wherein helicoids of the helicoidal illuminators having the same axis are both excited from a rear direction in a back-fire mode.

8. The antenna of claim 7, wherein points of connection of the helicoids to coaxial cables are located on their common axis.

9. The antenna of claim 4, wherein each of the two helicoids is connected to a respective coaxial cable, the two cables being symmetrically located with respect to the axis in the sections where they are separated and at a sufficient distance from the helicoids, such that an assembly formed by the helicoids is capable of receiving a protective radome.

10. The antenna of claim 9, wherein the coaxial cables connected to the two sources pass through a center of one sector of said sectors of paraboloids.

11. The antenna of claim 5, wherein the first and second sectors of paraboloids are mechanically connected by a section of a cone.

12. The antenna of claim 1, wherein at least one of the sectors of paraboloids is constituted from several sectors of different paraboloids whose virtual apices are offset by a whole number of half wavelengths, focusing the radiation at a same focus, said several sectors connected by sections of cones in order to reduce size.

13. The antenna of claim 1, wherein the reflector formed of sectors of paraboloids has a cross-sectional projection area of rectangular shape.

14. The antenna of claim 13, wherein the projection area is square in cross section.

15. A multi-focal receiving antenna for receiving radiation of a predetermined wavelength, said antenna having a single aiming direction for more than one satellite, the antenna comprising:

a reflector having at least two sectors of paraboloids, wherein respective axes of the paraboloids of the at least two sectors extend in a same direction with said at least two sectors having different focal points, and with the foci of said at least two sectors offset by a whole number of wavelengths of the radiation of a predetermined wavelength to be received;

said antenna further including a respective source for each of the at least two sectors for coupling the radiation, said sources located in zones of concentration of the radiation to be received, said sources merged with the respective axes of the at least two sectors of paraboloids, said sources respectively adapted for reception of differently polarized radiation; and wherein a first of said sectors is a sector of a paraboloid which forms a central zone, and a second of said sectors is a sector of a paraboloid which forms an external zone, and wherein said central zone is within said external zone;

wherein the sources are surface wave sources formed from helicoidal illuminators respectively connected to low noise amplifiers by coaxial cables;

wherein two helicoidal illuminators are provided which are respectively adapted for the reception of right and left circular polarization components of the radiation; and wherein an electromagnetic absorber is disposed between the two helicoidal illuminators such that the helicoidal illuminator which is most distant from the reflecting surfaces of the sectors of paraboloids is not disturbed by a backward wave focused on the other helicoidal illuminator.

16. A multi-focal receiving antenna for receiving radiation of a predetermined wavelength, said antenna having a single aiming direction for more than one satellite, the antenna comprising:

a reflector having at least two sectors of paraboloids, wherein respective axes of the paraboloids of the at least two sectors extend in a same direction with said at least two sectors having different focal points, and with the foci of said at least two sectors offset by a whole number of wavelengths of the radiation of a predetermined wavelength to be received;

said antenna further including a respective source for each of the at least two sectors for coupling the radiation, said sources located in zones of concentration of the radiation to be received, said sources merged with the respective axes of the at least two sectors of paraboloids, said sources respectively adapted for reception of differently polarized radiation; and wherein a first of said sectors is a sector of a paraboloid which forms a central zone, and a second of said sectors is a sector of a paraboloid which forms an external zone, and wherein said central zone is within said external zone;

wherein the sources are surface wave sources formed from helicoidal illuminators respectively connected to low noise amplifiers by coaxial cables;

wherein two helicoidal illuminators are provided which are respectively adapted for the reception of right and left circular polarization components of the radiation;

wherein the sectors of paraboloids have the same axis, which is also the axis of helicoids of the helicoidal illuminators, the foci of the sectors of the paraboloids being spaced on said same axis by $K\lambda$, and each sector having a symmetry of revolution about said same axis, wherein K is an integer and $\lambda$ is the wavelength of radiation to be received; and wherein one of the helicoids having the same axis is excited from a rear direction in a back-fire mode, and another helicoid is excited from an endward direction in an end-fire mode.

17. A multi-focal receiving antenna for receiving radiation of a predetermined wavelength, said antenna having a single aiming direction for more than one satellite, the antenna comprising:

a reflector having at least two sectors of paraboloids, wherein respective axes of the paraboloids of the at least two sectors extend in a same direction with said at least two sectors having different focal points, and with the foci of said at least two sectors offset by a spacing equal to a whole number of wavelengths of the radiation of a predetermined wavelength to be received, said reflector having a quasi-flat structure with respect to a direction along said axes;

said antenna further including a respective source for each of the at least two sectors for coupling the radiation, said sources located in zones of concentration of the radiation to be received, said sources merged with the respective axes of the at least two sectors of paraboloids, said sources respectively adapted for reception of differently polarized radiation; and wherein a first of said sectors is a sector of a first paraboloid, said first paraboloid forming a central zone, and the second of said sectors is a sector of a second paraboloid, said second paraboloid forming an external zone, and wherein said central zone is within said external zone, wherein said respective axes of the paraboloids of the first and second sectors extend along a common axis, with the foci of said first and second sectors spaced from each other on said common axis, and wherein a spacing between the respective foci of said first and second sectors along said common axis is equal to $K\lambda$, wherein K is an integer greater than zero, and $\lambda$ is the wavelength of radiation to be received.

18. A multi-focal receiving antenna for receiving radiation of a predetermined wavelength, said antenna having a single aiming direction for more than one satellite, the antenna comprising:

a reflector having at least two sectors of paraboloids, wherein respective axes of the paraboloids of the at least two sectors extend in a same direction with said at least two sectors having different focal points, and with the foci of said at least two sectors offset by a spacing equal to a whole number of wavelengths of the radiation of a predetermined wavelength to be received, said reflector having a quasi-flat structure with respect to a direction along said axes, said antenna further including a respective source for each of the at least two sectors for coupling the radiation, said sources located in zones of concentration of the radiation to be received, said sources merged with the respective axes of the at least two sectors of paraboloids, said sources respectively adapted for reception of differently polarized radiation; and wherein a first of said sectors is a sector of a first paraboloid, said first paraboloid forming a central zone, and the second of said sectors is a sector of a second paraboloid, said second paraboloid forming an external zone, and wherein said central zone is within said external zone, wherein said first and second paraboloids have parallel axes including a spacing between said parallel axes, said spacing equal to $K\lambda$, wherein K is an integer greater than zero and $\lambda$ is the wavelength of radiation to be received.

19. A multi-focal receiving antenna for receiving radiation of a predetermined wavelength, said antenna having a single aiming direction for more than one satellite, the antenna comprising:

a first plurality of sectors formed of a plurality of respective paraboloids forming a first family of paraboloids, wherein apices of the first family of paraboloids are offset by $K,\lambda/2$ with said first plurality of sectors focusing upon a first focal point, wherein $K_1$ is an integer greater than zero;

a second plurality of sectors formed of a second plurality of paraboloids with said second plurality of paraboloids forming a second family of paraboloids having apices offset by $K_2\lambda/2$ and with said second plurality of sectors focusing at a second focal point, wherein $K_2$ is an integer greater than zero and $\lambda$ is the wavelength of radiation to be received;

said antenna further including a respective source for each of the first and second plurality of sectors for coupling the radiation, said sources located in zones of concentration of the radiation to be received, said sources respectively adapted for reception of differently polarized radiations;

wherein said first and second focal points are offset by a whole number of wavelengths of the radiation of a predetermined wavelength to be received, and wherein the axes of the first family of paraboloids and the axes of the second family of paraboloids extend in a same direction, with the multi-focal receiving antenna having a quasi-flat structure with respect to a direction along said axes.

* * * * *